US010239105B2

(12) United States Patent
Ito et al.

(10) Patent No.: US 10,239,105 B2
(45) Date of Patent: Mar. 26, 2019

(54) BLANK STEEL PLATE, PRODUCTION METHOD AND PRODUCTION DEVICE THEREFOR, AND PRODUCTION METHOD FOR PRESS-FORMED PRODUCT USING BLANK STEEL PLATE

(71) Applicant: NIPPON STEEL & SUMITOMO METAL CORPORATION, Tokyo (JP)

(72) Inventors: Yasuhiro Ito, Amagasaki (JP); Yoshiaki Nakazawa, Takarazuka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 245 days.

(21) Appl. No.: 15/035,287

(22) PCT Filed: Nov. 17, 2014

(86) PCT No.: PCT/JP2014/005757
§ 371 (c)(1),
(2) Date: May 9, 2016

(87) PCT Pub. No.: WO2015/079644
PCT Pub. Date: Jun. 4, 2015

(65) Prior Publication Data

US 2016/0288186 A1 Oct. 6, 2016

(30) Foreign Application Priority Data

Nov. 28, 2013 (JP) ..... 2013-246215

(51) Int. Cl.
*B21D 11/08* (2006.01)
*B21D 22/20* (2006.01)
(Continued)

(52) U.S. Cl.
CPC ..... *B21D 11/08* (2013.01); *B21D 22/20* (2013.01); *B21D 47/00* (2013.01); *B21D 53/88* (2013.01)

(58) Field of Classification Search
CPC ..... B21D 11/08; B21D 11/085; B21D 22/26; B21D 53/88
See application file for complete search history.

(56) References Cited

FOREIGN PATENT DOCUMENTS

JP 01-289501 11/1989
JP 2007-014978 1/2007
(Continued)

*Primary Examiner* — Debra Sullivan
(74) *Attorney, Agent, or Firm* — Clark & Brody

(57) ABSTRACT

A blank steel plate is planar and used for producing a press-formed product that has an open cross-section including a bent portion. The blank steel plate is homogeneous in its entirety and includes a belt-shaped thick area that has an increased thickness, thin areas that are adjacent to both sides of the thick area and have a thickness smaller than the thickness of the thick area. On the front surface of a front surface and a back face of the blank steel plate, a step height in thickness is formed along one of both side portions of the thick area, and on the back face, a step height a thickness is formed along the other of both side portions of the thick area. By using the blank steel plate in producing the press-formed product, it is possible to optimizing the strength of the press-formed product, and suppress manufacturing costs.

7 Claims, 8 Drawing Sheets

(51) Int. Cl.
*B21D 47/00* (2006.01)
*B21D 53/88* (2006.01)

(56) References Cited

FOREIGN PATENT DOCUMENTS

| | | | | |
|---|---|---|---|---|
| JP | 2007014978 | A | * | 1/2007 |
| JP | 2008-296252 | | | 12/2008 |
| JP | 2009-291798 | | | 12/2009 |
| JP | 2010-120061 | | | 6/2010 |
| JP | 2013-049077 | | | 3/2013 |

* cited by examiner

A–A

BLANK STEEL PLATE, PRODUCTION METHOD AND PRODUCTION DEVICE THEREFOR, AND PRODUCTION METHOD FOR PRESS-FORMED PRODUCT USING BLANK STEEL PLATE

TECHNICAL FIELD

The present invention relates to a press-formed product suitable for structural members that form a car body of an automobile, in particular relates to a blank steel plate used for producing the press-formed product, and a production method and a production device therefor. Furthermore, the present invention relates to a production method for a press-formed product using the blank steel plate.

BACKGROUND ART

A car body of an automobile includes various structural members (e.g., a front side member, a rear side member, a center pillar reinforcement, and the like). For the structural members, press-formed products are heavily used, and the structural members are formed from a single press-formed product or formed by joining a plurality of press-formed products. The press-formed product used in the structural member has an open cross-section including a bent portion, and the cross-sectional shape thereof is hat-shaped or groove-shaped. Hereafter, a hat-shaped or groove-shaped cross-sectional shapes are also collectively referred to as hat-shaped. In a hat-shaped press-formed product, the bent portion of the cross section forms a ridge portion in appearance. Such a press-formed product is produced by using a planar steel plate as a starting material and subjecting the blank steel plate to press working.

In recent years, the fuel saving of automobiles has been promoted as one of the countermeasures against global warming problem. Thus, automobile bodies have a demand of reducing the weight thereof and securing a collision safety performance at the same time. To meet this demand, the strength of structural members are appropriately set in conformity with mounting location of the structural members in a car body. Furthermore, even in one structural member, the optimization of strength is made for each region.

In order to make the optimization of strength in a structural member, as a blank steel plate, a tailored welded blank (hereafter, referred to as a TWB), a tailored rolled blank (hereafter, referred to as a TRB), or the like has been employed. A TWB is a blank made by joining a plurality of kinds of steel plates by laser welding or the like, and has strength differences and thickness differences. A TRB is a blank made by rolling while the axis intervals between rolling mill rolls are adjusted in producing a steel plate, and has thickness differences and thereby substantially strength differences. A structural member produced from a TWB or TRB is enhanced in strength at appropriate spots and reduced in weight.

In addition, in a structural member using a hat-shaped press-formed product, when the thickness of a ridge portion, namely the thickness of a bent portion is larger than those of the other portions, the strength of the structural member is enhanced, and an impact energy absorbing performance or the like is enhanced. For such an advantage, a ridge portion of a structural member may be subjected to buildup welding.

A technique in which a TWB or a TRB as a blank steel plate is employed, or a technique in which a press-formed product is subjected to buildup welding, is effective to reduce the weight of a structural member and secure a collision safety performance. However, the technique in which a TWB is employed as a blank steel plate, or the technique in which a press-formed product is subjected to buildup welding compels the addition of a large-scale welding facility, requiring the augmentation of a complicated welding process. The technique in which a TRB is employed as a blank steel plate compels the addition of a large-scale rolling facility. Therefore, a significant rise in manufacturing costs is inevitable in both prior arts.

In contrast to the above prior arts that require a large-scale welding facility or rolling facility, press working with a pressing facility is excellent in multiplicity of use. For this reason, if the thickness of a structural member can be partially increased by press working to thereby partially enhance the strength of the structural member, the manufacturing costs of a structural member could be suppressed. Techniques in which the thickness of structural member is partially increased by press working will be described in the following literature.

Japanese Patent Application Publication No. 2010-120061 (Patent Literature 1) discloses a press-formed product and a production method therefor. The press-formed product described in Patent Literature 1 has an open cross-section including bent portions, and the cross-sectional shape thereof is hat-shaped. The press-formed product includes a pair of vertical wall portions and a top panel portion and curves in a gentle L shape in plan view. In the press-formed product, ridge portions that couple the vertical wall portions with the top panel portion correspond to bent portions of the cross sections. Furthermore, the thickness of the vertical wall portions on the inside of the curve and a part of the top panel portion adjacent to the vertical wall portion on the inside of the curve (including the ridge portions) is increased as compared to the portions other than thereof.

The press-formed product described in Patent Literature 1 is produced through the following process. A blank steel plate having a constant thickness is subjected to bending forming by press working and formed into a hat-shaped preparatory formed body. The preparatory formed body has a substantially constant thickness across its entirety, and the inside of the curve of the top panel portion is broadened inwardly in the curve together with the vertical wall portion, as compared with a press-formed product, which is an end product. Then, by press working using the other press die, the vertical wall portion on the inside of the curve of the top panel portion is pushed outwardly in the curve. At that point, a part of the top panel portion adjacent to the vertical wall portion on the inside of the curve is compressed to expand, and the thickness thereof increases. The resulting press-formed product has an increased thickness in a ridge portion on the inside of the curve.

Japanese Patent Application Publication No. 2008-296252 (Patent Literature 2) discloses a hat-shaped press-formed product and a production method therefor. The press-formed product described in Patent Literature 2 includes a pair of vertical wall portions and a top panel portion. Furthermore, in a specific range in a longitudinal direction, the thicknesses of the vertical wall portions and the top panel portion (including a ridge portion) are increased.

The press-formed product described in Patent Literature 2 is produced through the following process. A blank steel plate having a constant thickness is subjected to bending forming by press working and formed into a hat-shaped preparatory formed body. The preparatory formed body has a substantially constant thickness across its entirety, and the vertical wall portions extend in the specific range in the longitudinal direction, as compared with a press-formed product, which is an end product. Then, by press working using the other press dies, the top panel portion is pushed. At that point, the vertical wall portion is compressed to expand while being bent, and at the same time the top panel portion is crushed while being bent and expands, and the thicknesses thereof increase. The resulting press-formed product has an increased thickness in the vertical wall portions and the top panel portion (including a ridge portion) in the specific range in the longitudinal direction.

Japanese Patent Application Publication No. 2007-14978 (Patent Literature 3) discloses a hat-shaped press-formed product and a production method therefor. The press-formed product described in Patent Literature 3 includes a pair of vertical wall portions and a top panel portion. Furthermore, only in ridge portions that couple the vertical wall portions with the top panel portion, the thickness thereof is increased.

The press-formed product described in Patent Literature 3 is produced through the following process. A steel plate having a constant thickness is sandwiched between a pair of forging dies vertically disposed. On the opposing faces of these forging dies, recessed portions are formed at positions corresponding to ridge portions of the press-formed product. Furthermore, in the forging dies, heaters are embedded in the vicinities of the recessed portions. The steel plate is locally heated by the heaters, with the steel plate sandwiched between the forging dies. After the heating, upset dies disposed on the right and left side of the above forging dies are caused to operate to compress the steel plate in a direction perpendicular to the thickness direction. At that point, the steel plate buckles in the vicinities of the recessed portions of the forging dies, and flows into the recessed portions of the forging dies. This yields a planar blank steel plate having a partially increased thickness in areas corresponding to the recessed portions of the forging dies.

Subsequently, the planar blank steel plate having the partially increased thickness (hereafter, also referred to as a "partially thickened blank") is subjected to bending forming by press working using the other press dies. At that point, the press working is performed such that the thickened areas of the partially thickened blank form ridge portions (bent portions in a cross section) of the press-formed product. The resulting press-formed product has a thickness that increased only in the ridge portions.

CITATION LIST

Patent Literature

Patent Literature 1: Japanese Patent Application Publication No. 2010-120061

Patent Literature 2: Japanese Patent Application Publication No. 2008-296252

Patent Literature 3: Japanese Patent Application Publication No. 2007-14978

SUMMARY OF INVENTION

Technical Problem

In the techniques disclosed in Patent Literature 1 and 2, at the time of performing press working of a press-formed product, which is an end product, a hat-shaped preparatory formed body has to be first formed, and thus a special press die conforming to the shape of the preparatory formed body is indispensable. Further more, since a preparatory formed body having a constant thickness across its entirety is formed into a hat-shaped press-formed product having a partially increased thickness, a pressing facility having a special mechanism is needed in some cases. For these reasons, the rise in manufacturing costs is inevitable.

In addition, in the techniques disclosed in Patent Literature 1 and 2, in the final press working, there is the risk that buckling may occur in the top panel portion, the vertical wall portions, or the like. When buckling occurs, a press-formed product having a desired shape cannot be obtained. In particular, in producing a press-formed product made up of a high-tensile steel plate, such as a structural member of an automobile body, buckling is easy to occur.

It is therefore desirable that a blank steel plate used in press working of a press-formed product, which is an end product, is planar.

In the technique disclosed in Patent Literature 3, a blank steel plate used in press working of a press-formed product, which is an end product, is planar, partially thickened blank. However, to form this partially thickened blank, a special forging facility using the combination of the forging dies and the upset dies is indispensable. For this reason, the rise in manufacturing costs is inevitable.

In addition, in the partially thickened blank in Patent Literature 3, thickened areas projects from both of the front surface and back face of the steel plate. For this reason, step heights in thickness appear along both sides of the thickened areas, and moreover the step heights in thickness appear on both of the front surface and back face of the steel plate. Then, a press-formed product produced from this partially thickened blank has two traces of the step heights in thickness on the front side and the back side, which significantly reduces the quality in the appearance of the press-formed product.

The present invention is made in view of the above circumstances. The objective of the present invention is to provide, relating to a hat-shaped press-formed product suitable for a structural member of an automobile body, a blank steel plate used in producing a press-formed product having the following properties, a production method and a production device therefor, and a production method for a press-formed product using the blank steel plate:

- Capable of optimizing the strength of a press-formed product; and
- Capable of suppressing manufacturing cost.

Solution to Problem

A blank steel plate according to one embodiment of the present invention is a planar blank steel plate used for producing a press-formed product that has an open cross-section including a bent portion.

The blank steel plate is homogeneous across its entirety, and includes a belt-shaped thick area that has an increased thickness, and thin areas that are adjacent to both sides of the thick area and have a thickness smaller than the thick area.

On one of a front surface and a back face, a step height in thickness is formed along one of both side portions of the thick area, and on another of the front surface and the back face, a step height in thickness is formed along the other of both side portions of the thick area.

In the above blank steel plate, a hardness at a thickness center of the thick area is preferably higher than a hardness at a thickness center of the thin area.

In the above blank steel plate, the increase in the thickness of the thick area to the thickness of the thin area is preferably 20% or more.

A production method for a blank steel plate according to one embodiment of the present invention is a method for producing the above blank steel plate.

The production method for the blank steel plate includes:

a preparing process of preparing, as a starting material, a steel plate having a thickness that is constant and identical to the thickness of the thin area; and a forming process of forming the starting material into the blank steel plate by press working.

The forming process includes a first step and a second step.

In the first step, the starting material is segmented into a belt-shaped first area that has a width larger than the width of the thick area, and second areas that are adjacent to both side portions of the first area, and the second areas are displaced to different planes parallel to each other while causing the first area to incline with respect to the second areas.

In the second step, the second areas are displaced to be flush with each other while the second areas are restrained in terms of movement in a width direction, the width of the first area is compressed into the width of the thick area, and the thickness of the first area is increased to the thickness of the thick area.

In the production method for the above blank steel plate, it is preferable to employ the following configuration.

In the forming process, a press device is used, the press device including a punch, a blank holder that is disposed adjacent to the punch, a die that is disposed facing the blank holder and facing a part of the punch, and a pad that is disposed adjacent to the die and facing the punch.

In the first step, the starting material is pushed by the blank holder with one of the second areas of the starting material sandwiched between the punch and the pad. The push is continued while another of the second areas of the starting material is sandwiched between the blank holder and the die. The first area that inclines with respect to the second areas is thereby formed.

In the second step, the one second area is pushed by the punch and the pad until the one second area becomes flush with the other second area, and the first area is compressed by the punch and the die. The thick area, the thickness of which is increased from a thickness of the starting material, is formed.

In the production method for the above blank steel plate, in the first step, a width L [mm] of the inclined first area, a thickness t [mm] of the starting material, an inclination angle θ [°] of the first area with respect to the second area, and a yield strength YS [MPa] of the starting material preferably satisfy a condition represented by the following Formula (1).

$$(L/t)\times(1/\cos\theta)\leq -5.1\times10^{-6}\times(YS)^2+11.5 \quad (1)$$

A production device for a blank steel plate according to one embodiment of the present invention is a device for producing the above blank steel plate.

The production device for the blank steel plate is a device that uses, as a starting material, a steel plate having a thickness that is constant and identical to the thickness of the thin area, and forms the starting material into the blank steel plate by press working, the production device includes a punch, a blank holder that is disposed adjacent to the punch, a die that is disposed facing the blank holder and facing a part of the punch, and a pad that is disposed adjacent to the die and facing the punch, and an interval between the blank holder and the pad is identical to a width of the thick area of the blank steel plate.

In the production device for the above blank steel plate, a projecting portion is preferably provided on a surface of the die, the surface facing the blank holder, and the projecting portion has a height identical to or smaller than the thickness of the starting material.

A production method for a press-formed product according to one embodiment of the present invention is a production method for a press-formed product that has an open cross-section including a bent portion.

The production method for the press-formed product includes, using the above blank steel plate, subjecting the blank steel plate to press working such that the thick area of the blank steel plate forms the bent portion.

In the production method for the above press-formed product, by using a press device having: a punch that includes an impression portion in which a shape of the press-formed product is formed and a shoulder portion corresponding to the bent portion; and a pad and a die that are adjacent to each other and disposed facing the punch, press working is preferably performed with the thick area of the blank steel plate made to coincide with a position of the shoulder portion of the punch.

In the production method for the above press-formed product, the press working is preferably performed in a cold or warm manner.

In the production method for the above press-formed product, a hardness at a thickness center of the bent portion is preferably higher than a hardness at a thickness center of a flat portion that is adjacent to the bent portion. In this case, the hardness of the bent portion is preferably 1.2 times or more the hardness of the flat portion in teems of Vickers hardness.

In the production method for the above press-formed product, a thickness of the bent portion is preferably 1.2 times or more a thickness of a flat portion that is adjacent to the bent portion.

In the production method for the above press-formed product, the tensile strength of the blank steel plate is preferably 440 MPa or more.

In the production method for the above press-formed product, the shape of the open cross-section of the press-formed product is preferably hat-shaped or groove-shaped.

In the production method for the above press-formed product, the press-formed product is preferably a structural member of the car body of an automobile. For example, the structural member is a bumper reinforcement, a door impact beam, a front side member, a rear side member, a center pillar outer reinforcement, a floor cross member, a bulkhead, or a rocker reinforcement.

Advantageous Effects of Invention

A blank steel plate according to the present invention, a production method and a production device therefor, and a production method of a press-formed product using the blank steel plate have the following remarkable effects:

Capable of optimizing the strength of a press-formed product; and

Capable of suppressing manufacturing cost.

DESCRIPTION OF EMBODIMENTS

As described above, a blank steel plate to be used for press working of a press-formed product, which is an end product, is desirably planar. Furthermore, to enable the optimization of the press-formed product in strength, it is desirable to use a partially thickened blank as the blank steel plate. Furthermore, to enable the suppression of manufacturing cost, it is desirable to produce the partially thickened blank from a single steel plate not by welding, rolling, forging, or the like but by a simple press working.

In addition, in a structural member for which a hat-shaped press-formed product having an open cross-section is used, when the thickness of a ridge portion, namely the thickness of a bent portion is larger than that of flat portions (e.g., top panel portion, vertical wall portions), the strength of the structural member is enhanced, and an impact energy absorbing performance or the like is enhanced. To produce such a press-formed product, a partially thickened blank is preferable. Above all, if it is possible in a partially thickened blank to make the hardness of an area having an increased thickness higher than the hardnesses of the other areas, a further enhancement of the strength of the structural member (the press-formed product) can be expected. This is because the hardness of a press-formed product depends on the hardness of a partially thickened blank. The increase in hardness of a partially thickened blank can be achieved by applying work hardening when a partially thickened blank is formed by press working.

The present inventors conducted intense research in the light of the above circumstances and completed the present invention. Hereinafter, embodiments will be described in detail about a blank steel plate (partially thickened blank) according to the present invention, a production method and a production device therefor, and a production method of a press-formed product using the blank steel plate.

Press-Formed Product

Figure 1A:
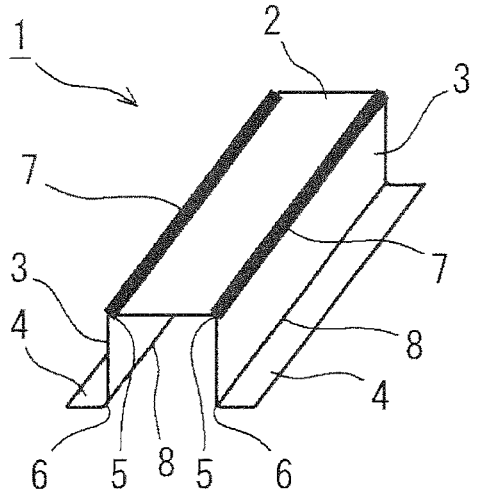
FIG. 1A is a perspective view of a press-formed product in a first example according to the present embodiment.
Figure 1B:
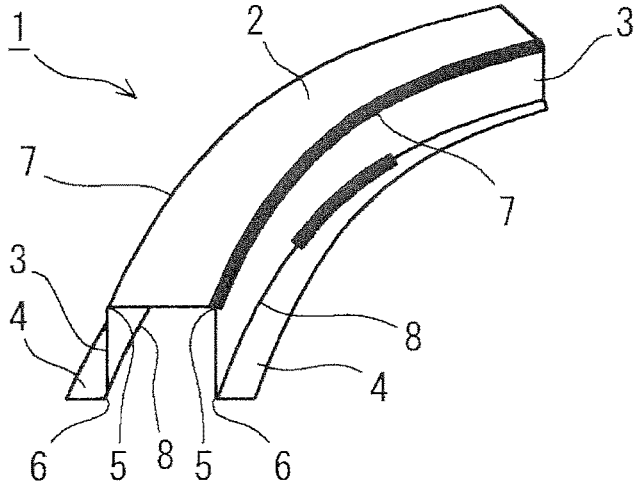
FIG. 1B is a perspective view of a press-formed product in a second example according to the present embodiment.
Figure 1C:
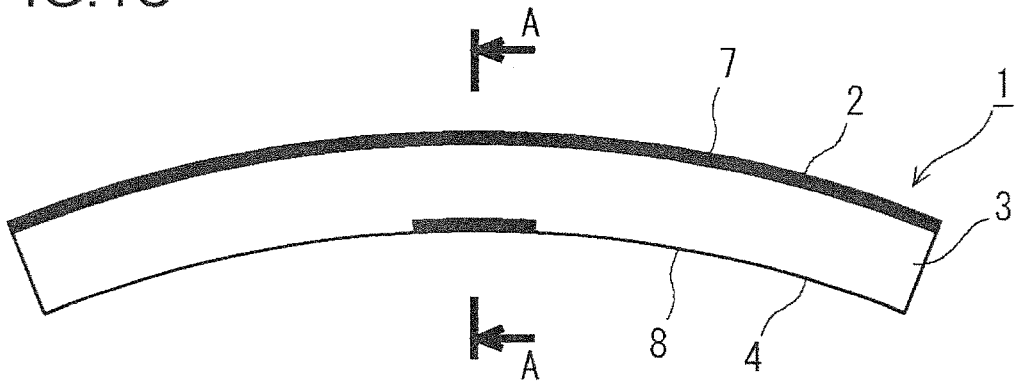
FIG. 1C is a side view of a press-formed product in a third example according to the present embodiment.
Figure 1D:
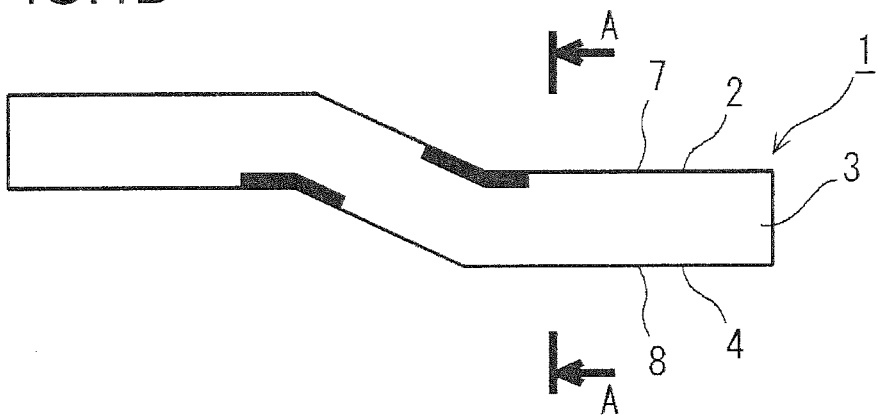
FIG. 1D is a side view of a press-formed product in a fourth example according to the present embodiment.
Figure 1E:
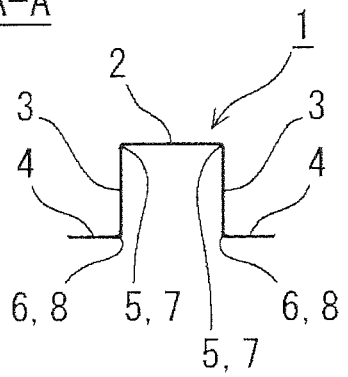
FIG. 1E is an A-A cross sectional view of the press-formed products illustrated in FIG. 1C and FIG. 1D.

FIG. 1A to FIG. 1E are diagrams illustrating representative examples of a press-formed product according to the present embodiment. Among the drawings, FIG. 1A is a perspective view of a press-formed product in a first example. FIG. 1B is a perspective view of a press-formed product in a second example. FIG. 1C is a side view of a press-formed product in a third example. FIG. 1D is a side view of a press-formed product in a fourth example. FIG. 1E is an A-A cross sectional view of the press-formed products illustrated in FIG. 1C and FIG. 1D.

Press-formed products 1 illustrated in FIG. 1A to FIG. 1E are all hat-shaped, having an open cross-section that includes bent portions 5 and 6. That is, the press-formed products 1 each include a top panel portion 2, a pair of vertical wall portions 3 on both sides, and a pair of flange portions 4 on both sides. The vertical wall portions 3 are coupled to the both side portions of the top panel portion 2 via the bent portions 5. The flange portions 4 are coupled to end portions of the vertical wall portions 3 via the bent portions 6.

The bent portion 5 coupling the vertical wall portion 3 with the top panel portion 2 forms a ridge portion 7 in appearance of the press-formed product 1. The bent portion 6 coupling the vertical wall portion 3 with the flange portion 4 also forms a ridge portion 8. The top panel portion 2, the vertical wall portions 3, and the flange portions 4 are flat portions in which slight curve, unevenness, or the like are tolerated. The press-formed product 1 is made up of a homogeneous steel plate.

In the press-formed product 1 in the first example illustrated in FIG. 1A, the top panel portion 2 and the vertical wall portions 3 are formed to be flat. This makes the press-formed product 1 in the first example have an external shape that linearly extends in side view and plan view.

In the press-formed product 1 in the second example illustrated in FIG. 1B, the top panel portion 2 is formed to be flat, and the vertical wall portions 3 are formed to gently curve in the thickness directions of the vertical wall portions 3. This makes the press-formed product 1 in the second example have an external shape that linearly extends in side view and gently curves in plan view.

In the press-formed product 1 in the third example illustrated in FIG. 1C and FIG. 1E, the top panel portion 2 and the vertical wall portions 3 are formed to gently curve in the thickness direction of the top panel portion 2. This makes the press-formed product 1 in the third example have an external shape that gently curves in side view.

In the press-formed product 1 in the fourth example illustrated in FIG. 1D and FIG. 1E, the top panel portion 2 and the vertical wall portions 3 are formed to curve in the thickness direction of the top panel portion 2 at two spots. This makes the press-formed product 1 in the fourth example have an external shape that curves at two spots in side view.

All the press-formed products 1 illustrated in FIG. 1A to FIG. 1E are hat-shaped in a strict sense. However, the press-formed product according to the present embodiment may be, for example, groove-shaped as long as having an open cross-section that includes a bent portion. In the case of a groove-shaped press-formed product, there is no flange portions 4 nor ridge portions 8 (bent portions 6) coupled to the flange portion 4 illustrated in FIG. 1A to FIG. 1E. That is, the groove-shaped press-formed product is formed of the top panel portion 2, the vertical wall portions 3, and the ridge portions 7 (bent portions 5) coupling them, illustrated in FIG. 1A to FIG. 1E.

Furthermore, in the present embodiment, the portions of the ridge portions 7 (bent portions 5) coupling the vertical wall portions 3 with the top panel portion 2, and the ridge portions 8 (bent portions 6) coupling the vertical wall portions 3 with the flange portions 4, which are illustrated by bold lines in FIG. 1A to FIG. 1D, have thicknesses that are increased as compared with the thicknesses of the other portions of the ridge portions and the flat portions (the top panel portion 2, the vertical wall portions 3, and the flange portions 4). Such thickened portions may be formed in some parts of the ridge portions or may be formed over the whole areas of the ridge portions. In addition, the thickened portions may be formed in all the ridge portions included in the press-formed product or may be formed in some ridge portions. Areas to place the thickened portions are determined in design as appropriate.

The press-formed products 1 according to the present embodiment are produced using partially thickened blanks to be described later. The production of the partially thickened blank according to the present embodiment uses a simple pressing facility and does not use a large-scale, special facility employed for the conventional TWB, TRB, the partially thickened blank described in Patent Literature 3, or the like. It is therefore possible to suppress the manufacturing cost.

Figure 2A:
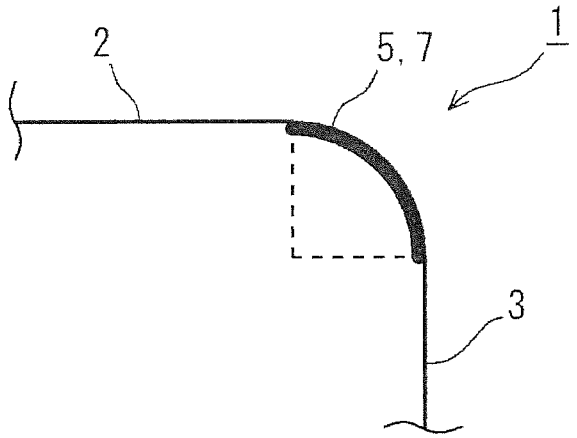
FIG. 2A is a cross sectional view illustrating an example of the vicinity of a ridge portion of a press-formed product according to the present embodiment.
Figure 2B:
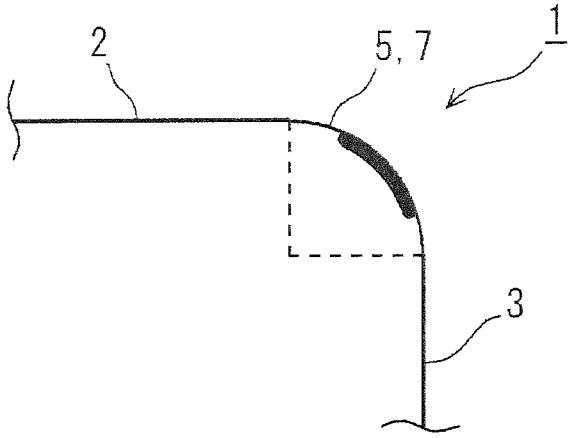
FIG. 2B is a cross sectional view illustrating another example of the vicinity of a ridge portion of a press-formed product according to the present embodiment.

FIG. 2A and FIG. 2B are cross sectional views illustrating examples of the vicinity of a ridge portion of a press-formed product according to the present embodiment. Both drawings illustrates a ridge portion 7 (bent portion 5) coupling a vertical wall portion 3 with a top panel portion 2, and the vicinity thereof in the press-formed products 1 illustrated in FIG. 1A to FIG. 1E. The bent portion 5 is a range between two ends of arcuate section. In FIG. 2A and FIG. 2B, the bold line in the bent portion 5 illustrates a thickened portion, as in FIG. 1A to FIG. 1D. FIG. 2A illustrates the state where the thickened portion is present over the whole range of the bent portion 5. FIG. 2B illustrates the state where the thickened portion is present in a part of the range of the bent portion 5.

In addition, the hardness at the thickness center (center in the thickness direction) of the ridge portion 7 is preferably higher than the hardnesses at the thickness centers of flat portions adjacent to the ridge portion 7 (the top panel portion 2 and the vertical wall portion 3). More specifically, the maximum hardness at the thickness center of the thickened portion in the ridge portion 7 is preferably higher than the minimum hardnesses at the thickness centers of the top panel portion 2 and the vertical wall portion 3, more preferably, 1.2 times or higher than the minimum hardnesses. All the hardnesses described herein are Vickers hardnesses (Hv).

The thickness of the ridge portion 7 is preferably 1.2 times or larger than the thickness of the flat portions adjacent to the ridge portion 7 (the top panel portion 2 and the vertical wall portion 3). More specifically, in the thickened portion of the ridge portion 7, the thickness at a position at which the hardness at the thickness center thereof reaches its maximum is preferably 1.2 times or higher than the thicknesses at positions where the hardnesses at the thickness centers of the top panel portion 2 and the vertical wall portion 3 reaches their minima. When this condition is satisfied, the strengths of the press-formed products 1 are effectively enhanced, and an impact energy absorbing performance is effectively enhanced. The reason for this will be described below.

The position at which the hardness at the thickness center in the thickened portion of the ridge portion 7 reaches its maximum corresponds to a thick area of a partially thickened blank to be described later, namely an area that is subjected to work when the partially thickened blank is formed by press working, and the thickness of which is most increased. In contrast to this, in the flat portions (the top panel portion 2 and the vertical wall portion 3), the positions where the hardnesses at the thickness centers reach their minima correspond to thin areas of a partially thickened blank to be described later, namely areas that are not subjected to work when the partially thickened blank is formed by press working and are unchanged as those of a starting material (steel plate). Here, the reason for defining the hardness at a thickness center is as follows. An area the thickness of which is most increased has the maximum hardness by work hardening. In contrast, areas the thicknesses of which are unchanged as those of a starting material do not have variations in hardness and has the minimum hardness. The following Table 1 shows the ratios of hardnesses of portions to the hardness of a blank steel plate having a constant thickness, which is defined as a reference (1.0).

TABLE 1

| | Hardness at thickness center | |
|---|---|---|
| Region | Bending forming steel plate having constant thickness into press-formed product (typical forming) | Bending forming partially thickened blank into press-formed product (present embodiment) |
| Top panel portion, vertical wall portion | Nearly identical (≈1.0) (because of unworked portion) | Nearly identical (≈1.0) (because of unworked portion) |
| Ridge portion (bent portion) | Nearly identical (≈1.0) (because portion is close to neutral axis and no distortion occurs) | ≥1.2 (due to work hardening) |

In general, in the case of simple bending forming in which a steel plate having a constant thickness is formed into a press-formed product, hardnesses are slightly increased on the outside and the inside of the ridge portion in a thickness direction. In addition, as shown in the above Table 1, since the thickness center of the ridge portion is positioned close to a neutral axis, the hardness at the thickness center hardly varies. In contrast to this, as in the present embodiment, in the case of bending forming in which a partially thickened blank to have an increased hardness partially and the partially thickened blank is formed into a press-formed product, hardness is significantly increased at the thickness center of the ridge portion.

The hat-shaped press-formed product 1 according to the present embodiment is configured such that the thicknesses of the ridge portions 7 and 8 (bent portions 5 and 6) are larger than the other flat portions (top panel portion 2 and vertical wall portions 3), and the optimization thereof in strength is therefore achieved. Therefore, such a press-formed product 1 is suited for a structural member of an automobile body. The exterior shape of the press-formed product 1 has not only linear shapes but also such curved shapes that are seen in the structural members of many automobile bodies. For example, such curved shapes include a curved shape curving in a horizontal direction, a curved shape curving in a vertical direction, and a combination thereof.

Structural members for which the press-formed product 1 according to the present embodiment is used include a bumper reinforcement, a door impact beam, a front side member, a rear side member, a center pillar outer reinforcement, a floor cross member, bulkhead, a rocker reinforcement, and the like. The overall length of the press-formed product 1 is from about 1000 mm, as in a bumper reinforcement, a front side member, a rear side member, or the like, to about 100 mm as in a cubic bulkhead.

A bumper reinforcement, a door impact beam, and a center pillar outer reinforcement are structural members that are assumed to be subjected to collapse by three-point bending occurring when a car body has a collision on the side face thereof (hereafter, referred to as three-point bending collapse). When the press-formed products 1, for example, illustrated in FIG. 1A and FIG. 1C, namely the press-formed products 1 having thickened ridge portions disposed on the outside of a car body are applied to such structural members, it is possible to enhance performances in the three-point bending collapse.

A front side member and a rear side member are structural members that are assumed to be subjected to collapse in an axis direction (longitudinal direction) occurring when a car body has a collision from the front or rear thereof (hereafter, referred to as axial collapse). When the press-formed product 1, for example, illustrated in FIG. 1D, namely the press-formed product 1 having a thickened ridge portion, among the ridge portions that curve at one, or two or more spots, positioned inside the curve is applied to this structural member, it is possible to enhance performances in the axial collapse.

The press-formed products 1 according to the present embodiment are produced using partially thickened blanks to be described later. When a partially thickened blank is formed by press working, a high-tensile steel plate having a tensile strength of 440 MPa or more can be used as a starting material. Therefore, the press-formed products 1 produced using partially thickened blanks according to the present embodiment have high strengths.

The partially thickened blank according to the present embodiment is made up of a homogeneous steel plate and has no weld zones seen in the TWB. Therefore, the press-formed products 1 produced using partially thickened blanks according to the present embodiment have no weld zones, and thus there is no risk of rupture in a weld zone at the time of collision.

In the press-formed products 1 according to the present embodiment, micro-structures in the thickened portions of the ridge portions (see the bold lines in FIG. 1A to FIG. 1D, and FIG. 2A and FIG. 2B) are work-hardening micro-structures made by press working. This is for the following reason. The thickened portions of the ridge portions are equivalent to thick areas of a partially thickened blank to be described later. The thick areas are caused to develop large distortions and subjected to work hardening by press working at the time of forming the partially thickened blank. For this reason, the micro-structures in the thickened portions of the ridge portions are the inheritance of work-hardening micro-structures in the thick areas of the partially thickened blank, so as to have work-hardening micro-structures.

Note that, in the case of a technique in which a TWB, a TRB, or the like is employed as a blank steel plate, thickened areas of the TWB or TRB are not subjected to work hardening, and thus the thickened portions of a press-formed product formed using the TWB or TRB do not have work-hardening micro-structures. Also in the case of a technique in which ridge portions of the press-formed product are subjected to buildup welding, the thickened portions subjected to the buildup welding do not have work-hardening micro-structures.

As will be described later, when a press-formed product 1 is produced by cold or warm press working using a partially thickened blank according to the present embodiment, the work-hardening micro-structures in the thick areas of the partially thickened blank are effectively carried on by the thickened portions of the ridge portions of the press-formed product 1. For this reason, the synergetic effect of thickening and work hardening to the ridge portions makes the press-formed product 1 more excellent in flexural rigidity, torsional rigidity, performances in three-point bending collapse, performances in axial collapse, and the like.

Blank Steel Plate (Partially Thickened Blank)

Figure 3A:
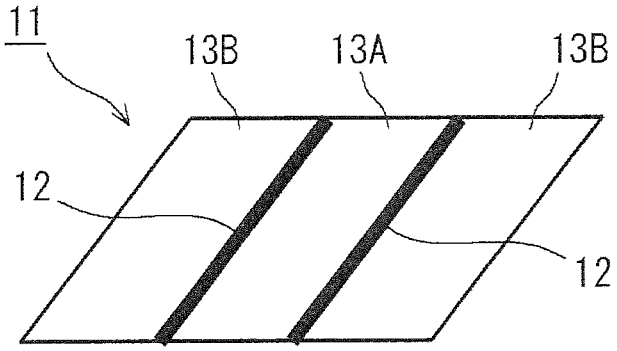
FIG. 3A is a diagram schematically illustrating an example of a blank steel plate according to the present embodiment, being a perspective view of the whole of the blank steel plate.
Figure 3B:
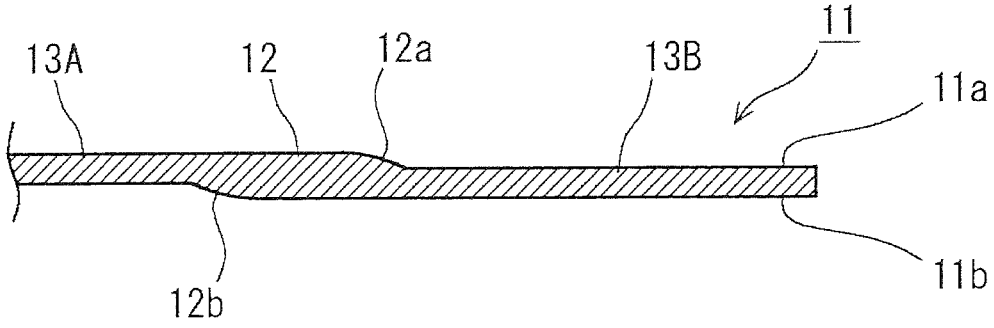
FIG. 3B is a diagram schematically illustrating the example of the blank steel plate according to the present embodiment, being a cross sectional view illustrating the vicinity of a thick area in a magnified manner.

FIG. 3A and FIG. 3B are diagrams schematically illustrating an example of the blank steel plate according to the present embodiment. Of these drawings, FIG. 3A is a perspective view of the whole of the blank steel plate. FIG. 3B is a cross sectional view illustrating the vicinity of a thick area in a magnified manner. A partially thickened blank 11, which is the blank steel plate illustrated in FIG. 3A and FIG. 3B, is an example of a partially thickened blank that is used for producing the press-formed product 1 in the first example illustrated in FIG. 1A. The press-formed product 1 in the first example is hat-shaped, and the vertical wall portions 3 and the flange portions 4 are symmetrically disposed across the top panel portion 2. Note that FIG. 3B illustrates the appearance from the center to one end portion of the partially thickened blank in the width direction thereof. The appearance as far as the other end portion is symmetrically identical and will not be illustrated.

The partially thickened blank 11 according to the present embodiment includes belt-shaped thick areas 12 having an increased thickness and thin areas 13A and 13B that are adjacent to the both sides of the thick areas 12 and having a thickness smaller than that of the thick areas. As illustrated in FIG. 3B, the thick areas 12 are provided at positions corresponding to the ridge portions 7, which are the thickened portions of the press-formed product 1 (see the bold lines in FIG. 1A). The thin areas 13A and 13B are provided at positions corresponding to the top panel portion 2, the vertical wall portions 3, and the flange portions 4 of the press-formed product 1.

In the partially thickened blank 11, on one of a front surface 11*a* and back face 11*b* (the front surface 11*a* in FIG. 3B), a step height 12*a* in thickness is formed along one side portion of the both side portions of the thick area 12. In addition, on the other of the front surface 11*a* and the back face 11*b* (the back face 11*b* in FIG. 3B), a step height 12*b* in thickness is formed along the other side portion of the both side portions of the thick area 12.

Such a partially thickened blank 11 is produced by press working using a simple press device to be described later. A starting material used in this production is a single steel plate. Therefore, the partially thickened blank 11 does not have a weld zone as in the TWB but is homogeneous across its entirety.

In the partially thickened blank 11, the hardness at the thickness centers of the thick areas 12 is higher than the hardness at the thickness centers of the thin areas 13A and 13B. As will be illustrated later, this is because the thick areas 12 are caused to develop large distortions and are subjected to work hardening by press working at the time of forming the partially thickened blank.

In addition, the increase in the thickness of the thick areas 12 with respect to the thickness of the thin areas 13A and 13B is 20% or more.

Producing Blank Steel Plate (Partially Thickened Blank)

Figure 4A:
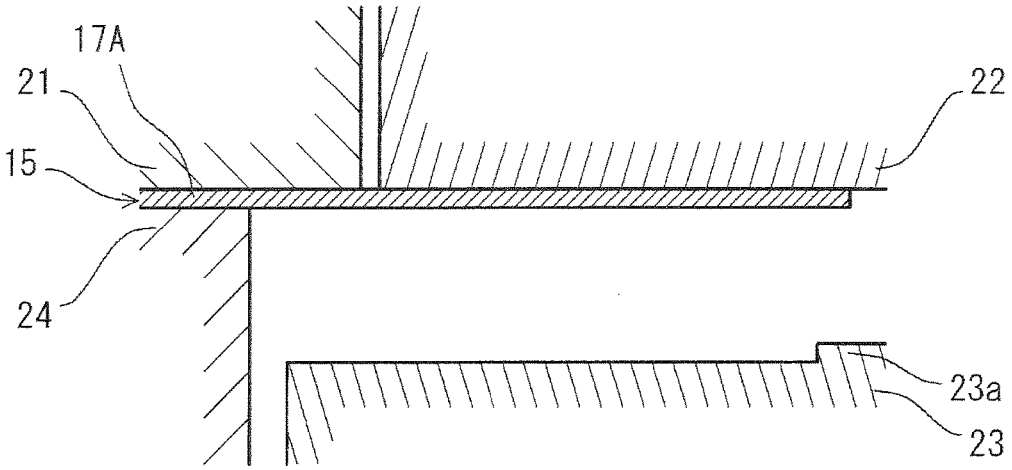
FIG. 4A is a cross sectional view schematically illustrating an example of a forming process of the blank steel plate according to the present embodiment, illustrating the state at the start of forming.
Figure 4B:
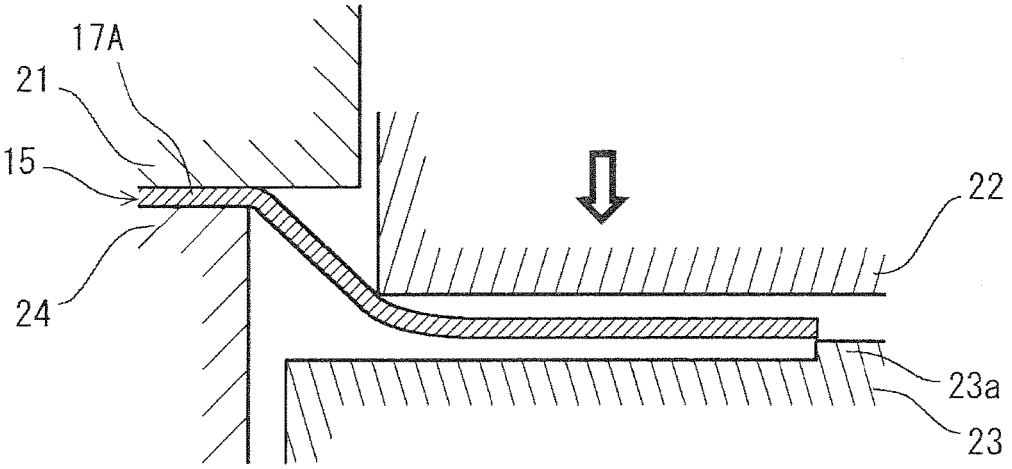
FIG. 4B is a cross sectional view schematically illustrating the example of the forming process of the blank steel plate according to the present embodiment, illustrating the state at the initial stage of forming.
Figure 4C:
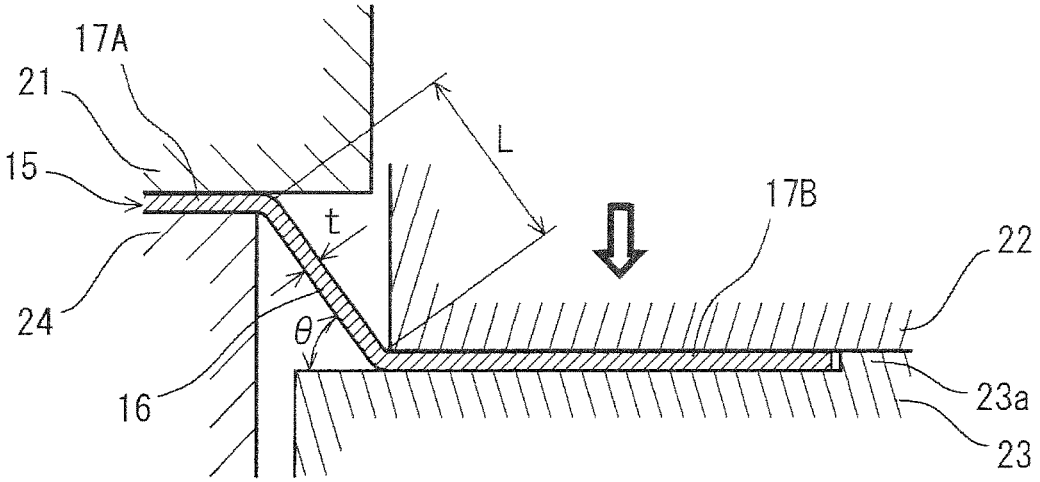
FIG. 4C is a cross sectional view schematically illustrating the example of the forming process of the blank steel plate according to the present embodiment, illustrating the state at the middle stage of forming.
Figure 4D:
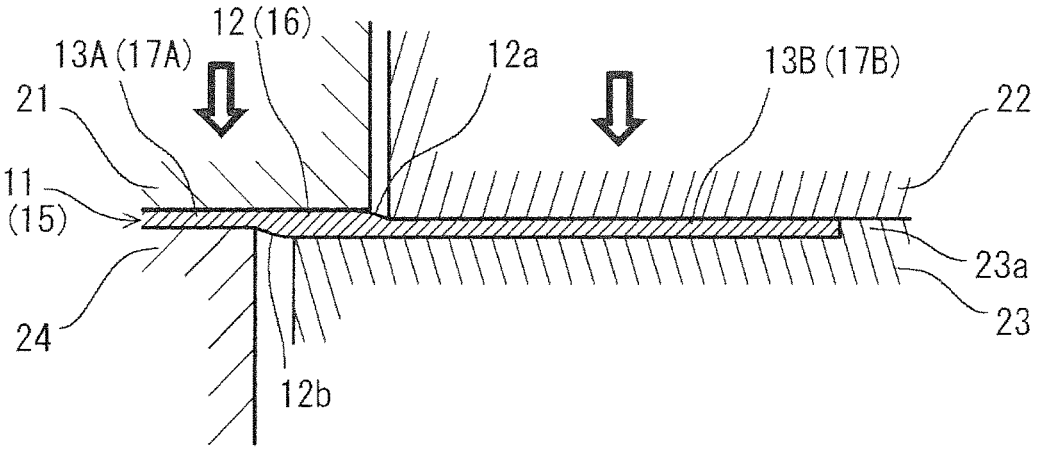
FIG. 4D is a cross sectional view schematically illustrating the example of the forming process of the blank steel plate according to the present embodiment, illustrating the state at the end of forming.

FIG. 4A to FIG. 4D are cross sectional views schematically illustrating an example of a forming process of a blank steel plate according to the present embodiment. Of these drawings, FIG. 4A illustrates the state at the start of forming. FIG. 4B illustrates the state at the initial stage of forming FIG. 4C illustrates the state at the middle stage of forming FIG. 4D illustrates the state at the end of forming. The forming process illustrated in FIG. 4A to FIG. 4D is an example of the case of forming the partially thickened blank 11 illustrated in FIG. 3A and FIG. 3B (to be used for producing the press-formed product 1 in the first example illustrated in FIG. 1A). Note that FIG. 4A to FIG. 4D illustrate the appearance from the center to one end portion of the steel plate in the width direction thereof. The appearance as far as the other end portion is symmetrically identical and will not be illustrated.

A production device for forming the partially thickened blank 11 (hereafter, referred to as a "blank production device") subjects a starting material 15, which is a steel plate having a constant thickness, to press working. The thickness of the starting material 15 is the same as that of the thin areas 13A and 13B of the partially thickened blank 11.

As illustrated in FIG. 4A to FIG. 4D, the blank production device includes a punch 21 and a blank holder 22 as an upper press die and includes a die 23 and a pad 24 as a lower press die. The blank holder 22 is disposed adjacent to the punch 21. The die 23 is disposed facing the blank holder 22 and facing a part of the punch 21. The pad 24 is disposed adjacent to the die 23 and facing the punch 21.

The punch 21 and the blank holder 22 can be moved up and down independently of each other. The pad 24 is urged toward the punch 21, and the pad 24 is moved down with a press by the descent of the punch 21 and is moved up with the release of the press by the ascent of the punch 21. The die 23 is immobilized.

The interval between the blank holder 22 and the pad 24 in the horizontal direction is set to be the same as the width of the thick areas 12 of the partially thickened blank 11. The term "the width of the thick areas 12" described here refers to, as illustrated in FIG. 3B, the width from the step height 12*a* formed on the one side portion of the thick area 12 to the step height 12*b* formed on the other side portion.

In addition, on the upper face of the die 23, namely the surface that faces the blank holder 22, a projecting portion 23*a* is provided. The projecting portion 23*a* is disposed closer to the center in the horizontal direction than an end portion of the starting material 15.

Using the blank production device having such a configuration, the partially thickened blank 11 is produced through the following processes. First, the starting material 15 is prepared. The type of a steel plate for the starting material 15 is not specially limited, and a high-tensile steel plate having a tensile strength of 440 MPa or more may be used.

In the state before forming, the punch 21 and the blank holder 22 of the upper press die is at a top dead center, being retracted upward from the pad 24 and the die 23 of the lower press die. In this state, the upper face of the pad 24 is disposed at a position higher than the upper face of the die 23. Then, the starting material 15 is placed on the pad 24.

From this state, forming by press working is started. First, the punch 21 and the blank holder 22 are moved down together, and the lower faces of the punch 21 and the blank holder 22 come into contact with the starting material 15. This makes, as illustrated in FIG. 4A, an area 17A, which is a part of the starting material 15, sandwiched between the punch 21 and the pad 24 and locked. The area 17A at the center of the starting material 15 in the width direction thereof corresponds to the area of the top panel portion 2 of the press-formed product 1 illustrated in FIG. 1A, namely the thin area 13A at the center of the partially thickened blank 11 in the width direction thereof illustrated in FIG. 3A.

Subsequently, the descent of the punch 21 is stopped, and only the descent of the blank holder 22 is continued. Then, the end portion of the starting material 15 is pushed by the blank holder 22. This causes, as illustrated in FIG. 4B, the starting material 15 is bent from the side portion of the area 17A locked by the punch 21 and the pad 24.

The push of the starting material 15 by the descent of the blank holder 22 is further continued. Then, as illustrated in FIG. 4C, an area 17B in an end portion of the starting material 15 is sandwiched between the blank holder 22 and the die 23 and locked. The blank holder 22 reaches a bottom dead center in this state. The area 17B in the end portion of the starting material 15 corresponds to the area of the vertical wall portion 3 and the flange portion 4 of the press-formed product 1 illustrated in FIG. 1A, namely the thin area 13B in an end portion of the partially thickened blank 11 illustrated in FIG. 3A.

The process thus far (hereafter, also referred to as a "first step") brings the starting material 15 into the state where, as illustrated in FIG. 4C, the area 17A sandwiched between the punch 21 and the pad 24, and the area 17B sandwiched between the blank holder 22 and the die 23 are displaced to different planes that are parallel to each other. In the space between the blank holder 22 and the pad 24, a belt-shaped area 16, which runs to the area 17A and the area 17B and inclines with respect to the both of them, is formed. The inclining area 16 of the starting material 15 corresponds to the areas of the ridge portions 7, which are the thickened portions of the press-formed product 1 illustrated in FIG. 1A (see the bold lines in FIG. 1A), namely the thick areas 12 of the partially thickened blank 11 illustrated in FIG. 3A.

In addition, the end face of the area 17B sandwiched between the blank holder 22 and the die 23 is in contact with or leaves a slight gap with respect to the side face of the projecting portion 23*a* on the die 23. FIG. 4C illustrates the state of leaving the slight gap.

Through the first step, the starting material 15 is segmented into the inclining area 16 (hereafter, also referred to as a "first area") and the areas 17A and 17B adjacent to the both side portions of the first area 16 and parallel to each other (hereafter, also referred to as "second areas"). A width L of the inclining first area 16 is larger than the width of the thick areas 12 of the partially thickened blank 11 illustrated in FIG. 3A. This is because the inclining first area 16 exists in the space between the blank holder 22 and the pad 24 in such a manner as to incline, and the interval of the space in the horizontal direction is set to be the same as the width of the thick areas 12.

Subsequently, the transition to a second step is made. In the second step, the descent of the punch 21 is resumed. Then, the area 17A, which is the width-direction-center portion of the starting material 15 (the second area), is pushed while being restrained in terms of movement in the width direction thereof by being sandwiched between the punch 21 and the pad 24. At that point, the area 17B in the end portion of the starting material 15 (the second area) is also restrained in terms of movement in the width direction thereof by being sandwiched between the blank holder 22 and the die 23. For this reason, the inclining first area 16 of the starting material 15 existing in the space between the blank holder 22 and the pad 24 is compressed to expand, and the inclination angle thereof is gradually lessened. This makes the thickness of the first area 16 gradually increase.

In addition, at that point, by the end face of the second area 17B coming into contact with the side face of the projecting portion 23*a* on the die 23, the movement of the second area 17B in the width direction thereof is reliably restrained. For this reason, even an insufficient restraint on the second area 17B by being sandwiched by the blank holder 22 and the die 23 has no trouble.

Subsequently, the push of the starting material 15 by the descent of the punch 21 is continued, and finally the punch 21 reaches the bottom dead center. That is, as illustrated in FIG. 4D, in the starting material 15, the area 17A sandwiched between the punch 21 and the pad 24 (the second area) becomes flush with the area 17B sandwiched between the blank holder 22 and the die 23 (the second area). In short, both the second areas 17A and 17B are displaced until they are flush with each other. In this state, the upper face of the pad 24 is disposed at a position that is slightly higher than the upper face of the die 23. The lower face of the punch 21 is disposed at a position that is slightly higher than the lower face of the blank holder 22.

This makes the width of the first area 16 compressed to the interval between the blank holder 22 and the pad 24 in the horizontal direction, namely the width of the thick areas 12 of the partially thickened blank 11 illustrated in FIG. 3A. Furthermore, the first area 16 expands by the compression and at the same time crushed into a flat plane by the punch 21 and the die 23 facing each other. As the result, the thickness of the first area 16 increases, becoming thicker than the thickness of the starting material 15 itself, namely the second areas 17A and 17B. The thickness of the first area 16 is determined by the interval between the lower face of the punch 21 and the upper face of the die 23, namely the position of the punch 21 at the bottom dead center.

As illustrated in FIG. 4D, by such press working, the partially thickened blank 11 illustrated in FIG. 3A and FIG. 3B is formed from the starting material 15. The belt-shaped first area 16 increasing in thickness becomes the thick area 12. The second areas 17A and 17B adjacent to the both sides of the first area 16 (thick area 12) become the thin areas 13A and 13B, which have a thickness smaller than that of the thick areas 12.

Here, in the first step of the above producing process for a partially thickened blank, a preferable condition for the formation of the inclining first area 16 are as follows.

Figure 5:
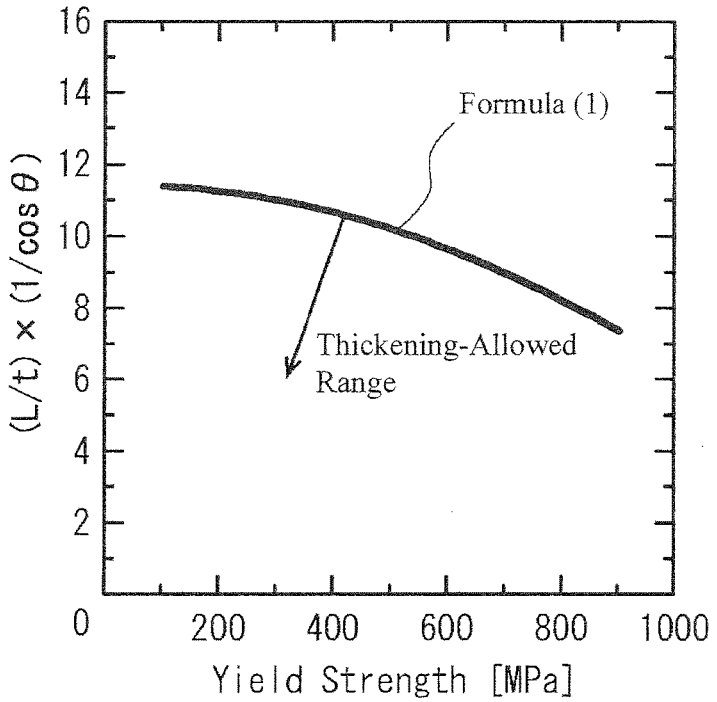
FIG. 5 is a diagram illustrating a thickening-allowed range in a producing process for a partially thickened blank.

FIG. 5 is a diagram illustrating a thickening-allowed range in the producing process for a partially thickened blank. As illustrated in FIG. 4C, at the time of forming the inclining first area 16, when the width of the first area 16 is denoted by L [mm], the thickness of the starting material 15 (first area 16) is denoted by t [mm], the inclination angle of the first area 16 with respect to the horizontal second areas 17A and 17B is denoted by θ [°], and the yield strength of the starting material 15 is denoted by YS [MPa], there is a correlation between them and the thickening-allowed range.

As illustrated in FIG. 5, if the condition represented by the following Formula (1) is satisfied, no buckling occurs in the process in which the inclining first area 16 is compressed and formed into the thick area 12.

$$(L/t)\times(1/\cos\theta)\times10^{-6}\times(YS)^2+11.5 \quad (1)$$

This condition represented by Formula (1) is valid when a steel plate having a tensile strength of 440 MPa or more is used as the starting material 15.

The present inventors conducted a test to form a partially thickened blank using various steel plates having tensile strengths ranging from 440 to 980 MPa, while varying the width L [mm], the thickness t [mm], the inclination angle θ [°] in the above Formula (1). On the basis of this test, the present inventors studied the influence of a steel plate strength on the possibility of partial thickening.

Here, the condition of failing to perform thickening working is determined to be a condition of bringing about a phenomenon where the inclining first area 16 buckles in a compression process and is thereby folded in an overlapping manner (hereafter, referred to as "overlap buckling"). The overlap buckling remains in a press-formed product in the end. For this reason, the press-formed product is degraded in appearance and considered to be a defective item. In addition, the overlap buckling may reduce fatigue characteristics or the like of the press-formed product.

In the case of using a 440 MPa-class steel plate, the overlap buckling occurred when "(L/t)×(1/cos θ)", a parameter into which the geometrical factors of the inclining first area 16 are combined (hereafter, also referred to as a "parameter Q"), becomes about 10.87 or more. The condition of making the parameter Q about 10.87 is, for example, the case where t=1.6 mm, L=10 mm, and θ=55°. In the case where the thickness t is small, the width L is large, and the inclination angle θ is large as compared with this condition, the overlap buckling is more prone to occur.

The present inventors conducted the same test on the other steel grades, and the overlap buckling occurred under the following conditions.

590 MPa-class steel plate: the condition that the parameter Q becomes about 10.58 (e.g., t=1.6 mm, L=10 mm, and θ=54°)

980 MPa-class steel plate: the condition that the parameter Q becomes about 9.17 (e.g., t=1.6 mm, L=10 mm, and θ=47°)

Thus, the present inventors studied the relation between the parameter Q the yield strength YS, a material property value having a high correlation with the occurrence of buckling. Here, the yield strengths YS of various steel plates are as follows.

440 MPa-class steel plate: the yield strength YS is 352 MPa

590 MPa-class steel plate: the yield strength YS is 424 MPa

980 MPa-class steel plate: the yield strength YS is 676 MPa

The present inventors found, as the result, that the overlap buckling can be suppressed if the parameter Q and the yield strength YS satisfy the condition represented by the above Formula (1).

The increase of the thickness of the first area 16 with respect to the thickness of the second areas 17A and 17B (hereafter, also referred to as a "thickening rate") is substantially "((1/cos θ)−1)×100" %. In a partially thickened blank, the thickening rate thereof is the increasing rate of the thickness of the thick area 12 with respect to the thickness of the thin areas 13A and 13B. The thickening rate is preferably 20% or more.

As long as the condition represented by the above Formula (1) is satisfied, the thickening working is possible. If a desired thickening rate, hardness, and the like cannot be obtained by one thickening working, the thickening working may be repeated on the same first area 16 a plurality of times.

The projecting portion 23*a* provided on the upper face of the die 23, as described above, comes into contact with the second area 17B of the starting material 15 to play a role of restraining the movement of the second area 17B in the width direction thereof (see FIG. 4D). The projecting portion 23*a* has a height identical to or smaller than the thickness of the starting material 15 (thickness of the thin areas 13A and 13B of the partially thickened blank 11). When the projecting portion 23*a* is higher than the thickness of the starting material 15, the projecting portion 23*a* comes into contact with the blank holder 22 when the blank holder 22 reaches the bottom dead center. This makes sandwiching of the second area 17B by the blank holder 22 and the die 23 insufficient, causing a wrinkle in the second area 17B. For example, when the thickness of the starting material 15 is 1.6 mm, the height of the projecting portion 23*a* may be set at 1.3 mm.

Note that, the above blank production device illustrated in FIG. 4A to FIG. 4D has the configuration in which the punch 21 and the blank holder 22 are disposed as the upper press die, and the die 23 and the pad 24 are disposed as the lower press die but may have the configuration in which the disposition of the upper and lower press dies is vertically reversed. In addition, as to the names of the upper and lower press dies, the press die having reference numeral 21 may be referred to as a pad instead of the punch, the press die having reference numeral 22 may be referred to as a die instead of the blank holder, the press die having reference numeral 24 may be referred to as a punch instead of the pad, and the press die having reference numeral 23 may be referred to as a blank holder instead of the die.

By the press working using the above blank production device, the above partially thickened blank 11 can be produced. The blank production device is simple and dispenses with a special press die and a special structure. Therefore, it is possible to suppress manufacturing cost to produce the partially thickened blank 11. In addition, the partially thickened blank 11 is planar and includes thick areas. For this reason, performing press working on the partially thickened blank 11 yields a press-formed product the strength of which can be optimized.

Producing Press-Formed Product

Figure 6A:
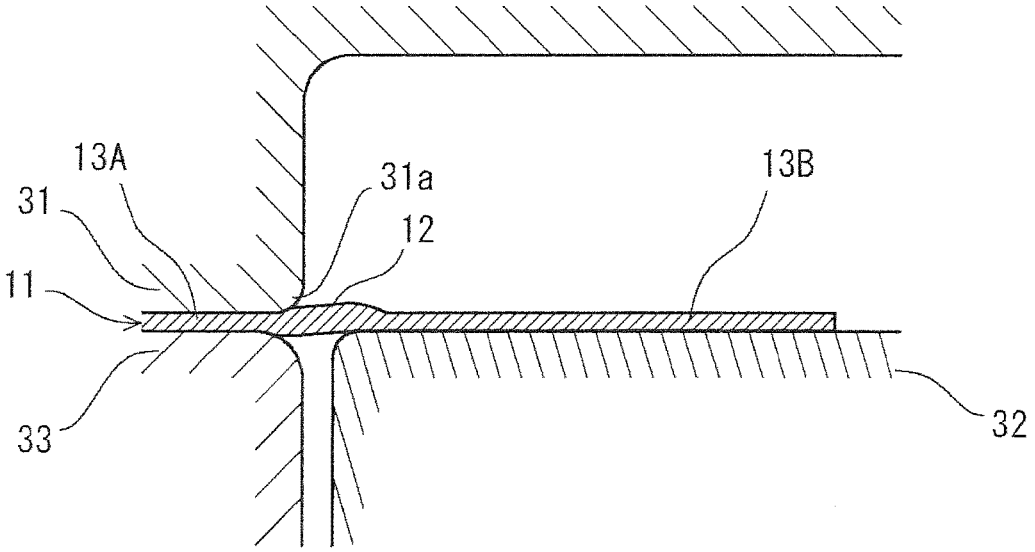
FIG. 6A is a cross sectional view schematically illustrating an example of a forming process of the press-formed product according to the present embodiment, illustrating the state at the start of forming.
Figure 6B:
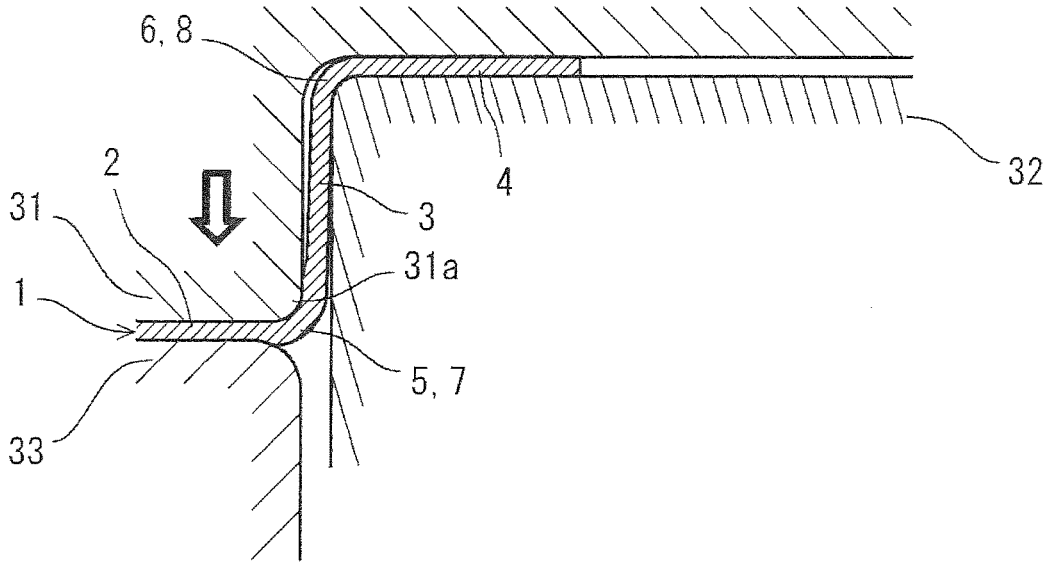
FIG. 6B is a cross sectional view schematically illustrating an example of a forming process of the press-formed product according to the present embodiment, illustrating the state at the end of forming.

FIG. 6A and FIG. 6B are cross sectional views schematically illustrating an example of a forming process of the press-formed product according to the present embodiment. Of these drawings, FIG. 6A illustrates the state at the start of forming. FIG. 6B illustrates the state at the end of forming. The forming process illustrated in FIG. 6A and FIG. 6B is an example of the case of forming the press-formed product 1 in the first example illustrated in FIG. 1A using the partially thickened blank 11 illustrated in FIG. 3A and FIG. 3B. Note that FIG. 6A and FIG. 6B illustrate the appearance from the center in the width direction to one end portion of a steel plate. The appearance as far as the other end portion is symmetrically identical and will not be illustrated.

A production device for forming the press-formed product 1 (hereafter, also referred to as a "pressed body production device") is a press device that uses the partially thickened blank 11 and performs press working such that the thick area 12 of the partially thickened blank 11 forms the ridge portions 7 (bent portions 5) of the press-formed product 1. As illustrated in FIG. 6A and FIG. 6B, the pressed body production device includes punch 31 as an upper press die, and includes a die 32 and a pad 33 as a lower press die.

The punch 31 includes an impression portion in which the shape of the press-formed product 1 is formed and a shoulder portion 31*a* that corresponds to the ridge portion 7 (bent portion 5) of the press-formed product 1, as a part of the impression portion. The die 32 and the pad 33 are adjacent to each other, both of which are disposed facing the punch 31. The pad 33 is a press die for forming the top panel portion 2 of the press-formed product 1 and is disposed on the center side from the shoulder portion 31*a* of the punch 31 in the horizontal direction. The die 32 is a press die for forming the vertical wall portions 3 and the flange portions 4 of the press-formed product 1.

The punch 31 can be moved up and down. The pad 33 is urged toward the punch 31 and is moved down with a press by the descent of the pad 33 and is moved up with the release of the press by the ascent of the pad 33. The die 32 is immobilized.

Using the pressed body production device having such a configuration, the press-formed product 1 is produced through the following process. In the state before forming, the punch 31 of the upper press die is at a top dead center, being retracted upward from the pad 33 and the die 32 of the lower press die. In this state, the upper face of the pad 33 is identical in height to the upper face of the die 32. Then, the above partially thickened blank 11 is placed on the pad 33 and the die 32. In this state, of the thin areas 13A and 13B of the partially thickened blank 11, the thin area 13A at the center in a width direction is disposed on the pad 33, and the thin area 13B in an end portion are disposed on the die 32. The thick area 12 of the partially thickened blank 11 coincides with a position immediately below the shoulder portion 31 a of the punch 31.

From this state, forming by press working is started. First, the punch 31 is moved down, coming into contact with the partially thickened blank 11. This brings the state that, as illustrated in FIG. 6A, the thin area 13A at the center in the width direction of the partially thickened blank 11 is sandwiched between the punch 31 and the pad 33 and locked.

Subsequently, the descent of the punch 31 is continued. Then, the thin area 13B in the end portion of the partially thickened blank 11 is pushed by the die 32. This causes the partially thickened blank 11 to be bent from the thick area 12. As the result, the bent portion 5 (ridge portion 7) is formed in the thick area 12, and with the formation of the bent portion 5, the thin area 13A sandwiched between the punch 31 and the pad 33 becomes the top panel portion 2.

Furthermore, the push of the partially thickened blank 11 by the descent of the punch 31 is continued, and finally the punch 31 reaches a bottom dead center. This causes, as illustrated in FIG. 6B, the bent portion 6 (ridge portion 8) to be formed in the thin area 13B in the end portion of the partially thickened blank 11, and with the formation of the bent portion 5, the vertical wall portions 3 and the flange portions 4 are formed.

By such press working, the press-formed product 1 illustrated in FIG. 1A is formed from the above partially thickened blank 11.

As described above, by using the above pressed body production device, and subjecting the above partially thickened blank 11 to press working, it is possible to produce the press-formed product 1 having a partially large thickness, and for which the optimization of strength is possible. The pressed body production device is, as with the above blank production device, is simple and dispenses with a special press die and a special structure. Therefore, it is possible to suppress manufacturing costs in producing not only the partially thickened blank 11 but also the press-formed product 1.

The press working by the above pressed body production device may be performed in a cold manner or in a warm manner. Warren press working means that the press working is performed in the state where the temperature of the partially thickened blank 11 in forming start is from 200° C. to less than the point $Ac_3$. In contrast, cold press working means that the press working is performed in the state where the temperature of the partially thickened blank 11 in forming start is less than about 200° C. By the cold or warm press working, the work-hardening micro-structure in the thick area 12 of the partially thickened blank 11 is effectively carried on by the thickened portions of the ridge portions of the press-formed product 1.

In addition, in the above partially thickened blank 11, one trace of the step heights 12*a* and 12*b* in thickness between the thick area 12 and the thin areas 13A and 13B appear on the front surface 11*a* and the back face 11*b*, respectively. Then, in the ridge portions 7 of the press-formed product 1 produced from the partially thickened blank 11, only one trace of the step height in thickness is left on each of the front side and the back side. Therefore, the press-formed product 1 is excellent in quality in the appearance as compared with a press-formed product produced from the partially thickened blank of Patent Literature 3.

Note that the above pressed body production device illustrated in FIG. 6A and FIG. 6B has the configuration in which the punch 31 is disposed as the upper press die and the die 32 and the pad 33 are disposed as the lower press die but may have the configuration in which the disposition of the upper and lower press dies is vertically reversed.

EXAMPLES

To confirm the effects of the present invention, the present inventors conducted the tests on the following Examples 1 and 2.

Example 1

In Example 1, three kinds of structural members: a comparative example; a conventional example; and an inventive example of the present invention, were fabricated, and a three-point bending collapse test was conducted on each structural member.

(1) Structural Member

Figure 7:
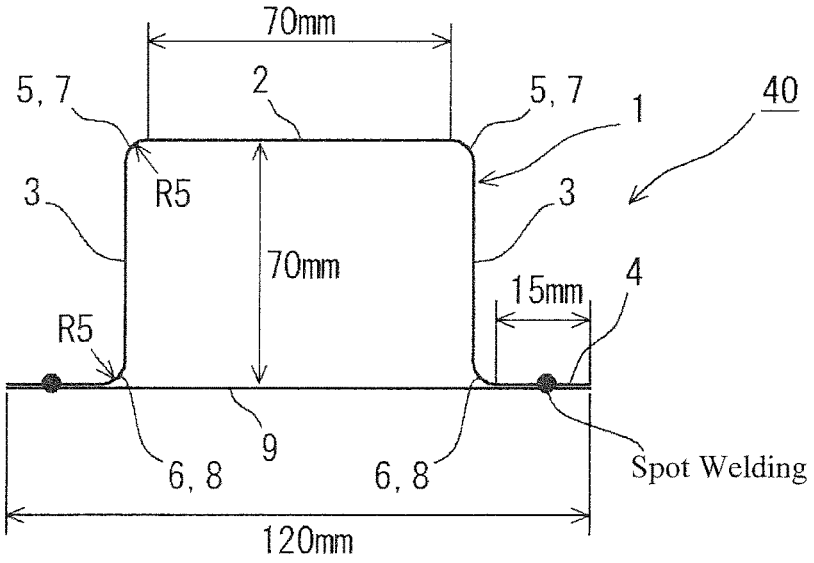
FIG. 7 is a schematic diagram illustrating a cross-sectional shape of a structural member used in the three-point bending collapse test in Example 1.

FIG. 7 is a schematic diagram illustrating a cross-sectional shape of a structural member used in the three-point bending collapse test in Example 1. As illustrated in FIG. 7, a structural member 40 used in Example 1 was fabricated by combining a hat-shaped press-formed product 1 with a closing plate 9 and joining them by spot welding. The press-formed product 1 includes a top panel portion 2, a pair of vertical wall portions 3, and a pair of flange portions 4, and includes bent portions 5 (ridge portions 7) coupling the top panel portion 2 with the vertical wall portions 3, bent portions 6 (ridge portions 8) coupling the vertical wall portions 3 with the flange portions 4. Three producing conditions of the press-formed product 1 were selected and determined as the comparative example, the conventional example, and the inventive example of the present invention.

The spot welding was performed on the flange portions 4 of the press-formed product 1. Intervals of the spot welding were 30 mm along the longitudinal direction of the structural member 40. As the closing plate 9, a 440 MPa-class steel plate having a thickness of 1.8 mm was used.

In the comparative example, a normal blank steel plate was formed into the hat-shaped press-formed product 1 by press working. As the blank steel plate, a 440 MPa-class steel plate having a constant thickness of 1.6 mm was used. The thickness of the press-formed product 1 in the comparative example substantially remained the thickness of the blank steel plate across its entirety including the ridge portions 7. The maximum hardness (Hv) at the thickness centers of the ridge portion 7 was substantially equal to the hardness of the blank steel plate. Note that the hardness (Hv) of the outside of the bends in the ridge portions 7 in the comparative example was about 1.23 times the hardness of the blank steel plate due to work hardening in the press working.

In the conventional example, a TRB was formed into the hat-shaped press-formed product 1 by press working. The TRB was formed by partially rolling a steel plate having a constant thickness of 2.0 mm to form thinned areas, forming thickened areas in a relative manner by the formation of these thinned areas. The thickness of these thinned areas was about 1.6 mm. The thickness of the thickened areas was 2.0 mm. The TRB was subjected to heat treatment before the press working to make the strength of the thickened areas equal to that of a 440 MPa-class steel plate. The press working was performed such that the thickened areas were formed into the ridge portions 7.

The thicknesses of the press-formed product 1 in the conventional example were substantially kept at the thicknesses of the TRB, 2.0 mm maximum in the ridge portions 7, and approximately 1.6 mm in the portions other than the ridge portions 7. That is, the thickness of the ridge portions 7 was 1.25 times the thickness of the portions other than the ridge portions 7. The maximum hardness (Hv) at the thickness centers of the ridge portions 7 was substantially equal to the hardness of the TRB. Note that the hardness (Hv) of the outside of the bends in the ridge portions 7 in the conventional example was about 1.26 times the hardness of the TRB due to work hardening in the press working.

In the inventive example of the present invention, the partially thickened blank in the above present embodiment was formed into the hat-shaped press-formed product 1 by press working. This partially thickened blank was obtained by preparing a 440 MPa-class steel plate having a constant thickness 1.6 mm as a starting material, which was subjected to the partial thickening working according to the above present embodiment. The thickness of the partially thickened thick areas was 2.0 mm maximum. The press working was performed such that the thick areas were formed into the ridge portions 7.

The thicknesses of the press-formed product 1 in the inventive example of the present invention were substantially kept at the thicknesses of the partially thickened blank, 2.0 mm maximum in the ridge portions 7, and approximately 1.6 mm in the portions other than the ridge portions 7. That is, the thickness of the ridge portions 7 was 1.25 times the thickness of the portions other than the ridge portions 7. The maximum hardness (Hv) at the thickness centers of the ridge portions 7 was about 1.40 times the hardness of the starting material before the partial thickening working. Note that the same was true for the hardness (Hv) of the outside of the bends in the ridge portions 7 in the inventive example of the present invention.

(2) Condition of Three-Point Bending Collapse Test

Figure 8:
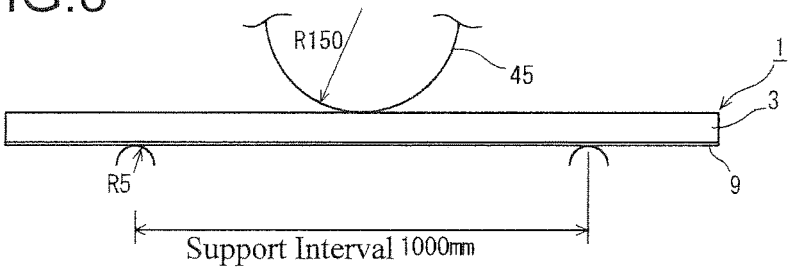
FIG. 8 is a schematic diagram illustrating the outline of the three-point bending collapse test.

FIG. 8 is a schematic diagram illustrating the outline of the three-point bending collapse test. The structural member 40 was supported at two points from the side of the closing plate 9. A support interval for the structural member 40 was determined to be 1000 mm. In the middle of the supports for the structural member 40, an impactor 45 was caused to collide with the press-formed product 1 from the side of the top panel portion 2 thereof so as to collapse the structural member 40. The radius of curvature of the front end portion of the impactor 45 was 150 mm. The collision speed of the impactor 45 was 64 km/h.

(3) Evaluation and Result of Test

For the structural members in the comparative example, the conventional example, and the inventive example of the present invention, maximum loads in the three-point bending collapse test were measured. The evaluation was made using the ratio to a maximum load in the comparative example, with the maximum load in the comparative example defined as a reference (1.00). The results are shown in Table 2.

TABLE 2

| Category | Comparative example | Conventional example | Inventive example of present invention |
|---|---|---|---|
| Blank steel plate | Normal blank having constant thickness | Partially thickened blank (TRB) | Partially thickened blank (partial thickening working according to present embodiment) |
| Hardness ratio at thickness center | 1.02 | 1.01 | 1.40 |
| Maximum thickness of ridge portion | 1.6 mm (thickness ratio: 1.00) | 2.0 mm (thickness ratio: 1.25) | 2.0 mm (thickness ratio: 1.25) |
| Maximum load ratio | 1.00 | 1.05 | 1.12 |

As shown in Table 2, the maximum load ratio in the conventional example was about 1.05. In contrast to this, the maximum load ratio in the inventive example of the present invention was 1.12. This demonstrated that the structural member in the inventive example of the present invention employing the technique of the present embodiment has a high performance in the three-point bending collapse brought by the influences of partial thickening and significant work hardening.

Example 2

In Example 2, three kinds of structural members: a comparative example; a conventional example; and an inventive example of the present invention, were fabricated, and an axial collapse test was conducted on each structural member.

(1) Structural Member

Figure 9:
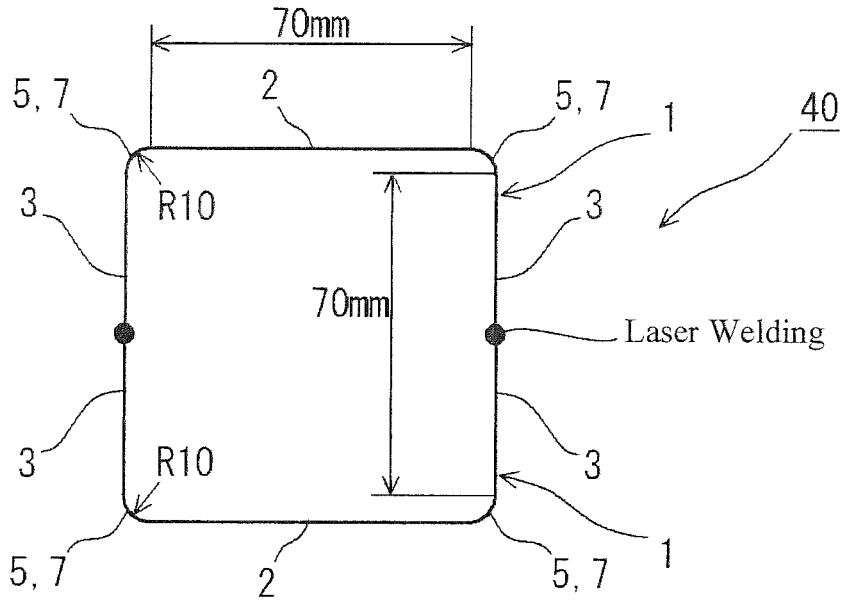
FIG. 9 is a schematic diagram illustrating a cross-sectional shape of a structural member used in the axial collapse test in Example 2.

FIG. 9 is a schematic diagram illustrating a cross-sectional shape of a structural member used in the axial collapse test in Example 2. As illustrated in FIG. 9, a structural member 40 used in Example 2 was fabricated by combining a pair of groove-shaped press-formed products 1, and joining them by laser welding. Each press-formed product 1 includes a top panel portion 2, and a pair of vertical wall portions 3, and includes bent portions 5 (ridge portions 7) coupling the top panel portion 2 with the vertical wall portions 3. Three producing conditions of the press-formed product 1 were selected and determined as the comparative example, the conventional example, and the inventive example of the present invention. The overall length of the press-formed product 1 was determined to be 150 mm. The laser welding was performed between the vertical wall portions 3 of the press-formed products 1.

In the comparative example, a normal blank steel plate was formed into the groove-shaped press-formed product 1 by press working. As the blank steel plate, a 440 MPa-class steel plate having a constant thickness of 1.6 mm was used. The thickness of the press-formed product 1 in the comparative example substantially remained the thickness of the blank steel plate across its entirety including the ridge portions 7. The maximum hardness (Hv) at the thickness centers of the ridge portions 7 was substantially equal to the hardness of the blank steel plate. Note that the hardness (Hv) of the outside of the bends in the ridge portions 7 in the comparative example was about 1.23 times the hardness of the blank steel plate.

In the conventional example, a TRB was formed into the groove-shaped press-formed product 1 by press working. This TRB was formed by partially rolling a steel plate having a constant thickness of 2.0 mm to form thinned areas, forming thickened areas in a relative manner by the formation of these thinned areas. The thickness of these thinned areas was about 1.6 mm. The thickness of the thickened areas was 2.0 mm. The TRB was subjected to heat treatment before the press working to make the strength of the thickened areas equal to that of a 440 MPa-class steel plate. The press working was performed such that the thickened areas were formed into the ridge portions 7.

The thicknesses of the press-formed product 1 in the conventional example were substantially kept at the thicknesses of the TRB, 2.0 mm maximum in the ridge portions 7, and approximately 1.6 mm in the portions other than the ridge portions 7. That is, the thickness of the ridge portions 7 was 1.25 times the thickness of the portions other than the ridge portions 7. The maximum hardness (Hv) at the thickness centers of the ridge portions 7 was substantially equal to the hardness of the TRB. Note that the hardness (Hv) of the outside of the bends in the ridge portions 7 in the conventional example was about 1.26 times the hardness of the TRB.

In the inventive example of the present invention, the partially thickened blank in the above present embodiment was formed into the groove-shaped press-formed product 1 by press working. This partially thickened blank was obtained by preparing a 440 MPa-class steel plate having a constant thickness of 1.6 mm as a starting material, which was subjected to the partial thickening working according to the above present embodiment. The thickness of the partially thickened thick areas was 2.0 mm maximum. The press working was performed such that the thick areas were formed into the ridge portions 7.

The thicknesses of the press-formed product 1 in the inventive example of the present invention were substantially kept at the thicknesses of the partially thickened blank, 2.0 mm maximum in the ridge portions 7, and approximately 1.6 mm in the portions other than the ridge portions 7. That is, the thickness of the ridge portions 7 was 1.25 times the thickness of the portions other than the ridge portions 7. The maximum hardness (Hv) at the thickness centers of the ridge portions 7 was about 1.40 times the hardness of the starting material before the partial thickening working. Note that the same was true for the hardness (Hv) of the outside of the bends in the ridge portions 7 in the inventive example of the present invention.

(2) Condition of Axial Collapse Test

Of both end portions of the structural member 40 in the longitudinal direction thereof, one end portion is immobilized. From the other of both end portions of this structural member 40, an impactor was caused to collide with the structural member 40 so as to collapse the structural member 40 in the axis direction thereof. The collision speed of the impactor was 10 km/h.

(3) Evaluation and Result of Test

For the structural members in the comparative example, the conventional example, and the inventive example of the present invention, absorbed energies EA of the time when the stroke of the impactor reached 100 mm in the axial collapse test were measured. The evaluation was made using the ratio to an absorbed energy EA in the comparative example, with the absorbed energy EA in the comparative example defined as a reference (1.00). The results are shown in Table 3.

TABLE 3

| Category | Comparative example | Conventional example | Inventive example of present invention |
|---|---|---|---|
| Blank steel plate | Normal blank having constant thickness | Partially thickened blank (TRB) | Partially thickened blank (partial thickening working according to present embodiment) |
| Hardness ratio at thickness center | 1.02 | 1.01 | 1.40 |
| Maximum thickness of ridge portion | 1.6 mm (thickness ratio: 1.00) | 2.0 mm (thickness ratio: 1.25) | 2.0 mm (thickness ratio: 1.25) |
| Absorbed energy EA ratio | 1.00 | 1.10 | 1.31 |

As illustrated in Table 3, the EA ratio in the conventional example was about 1.10. In contrast, the EA ratio in the inventive example of the present invention was 1.31. This demonstrated that the structural member in the inventive example of the present invention employing the technique of the present embodiment has a high EA performance brought by the influences of partial thickening and significant work hardening.

REFERENCE SIGNS LIST

1: press-formed product
2: top panel portion
3: vertical wall portion
4: flange portion
5, 6: bent portion
7, 8: ridge portion
9: closing plate
11: partially thickened blank (blank steel plate)
11*a*: front surface
11*b*: back face
12: thick area
12*a*, 12*b*: step height
13A, 13B: thin area
15: starting material
16: first area
17A, 17B: second area
21: punch
22: blank holder
23: die
23*a*: projecting portion
24: pad
31: punch
31*a*: shoulder portion
32: die
33: pad
40: structural member
45: impactor

The invention claimed is:

1. A method for producing a planar blank steel plate comprising:

a preparing step of preparing, as a starting material, a steel plate having a thickness that is constant; and a forming process of forming the starting material into the blank steel plate by press working, wherein the forming process includes:

a first step of segmenting the starting material into a belt-shaped first area that has a width, and second areas that are adjacent to both side portions of the first area, and displacing the second areas to different planes parallel to each other while causing the first area to incline with respect to the second areas; and a second step of displacing the second areas to be flush with each other while restraining the second areas in terms of movement in a width direction so as to compress the width of the first area into a width of a thick area and increase a thickness of the first area to a thickness of the thick area to make the blank steel plate, wherein the blank steel plate is homogeneous across its entirety, the blank steel plate includes a belt-shaped thick area with an increased thickness, and thin areas that are adjacent to both sides of the thick area and have a thickness smaller than the thickness of the thick area, on one of a front surface and a back face of the blank steel plate, a step height in thickness is formed along one of both side portions of the thick area, and on another of the front surface and the back face of the blank steel plate, a step height in thickness is formed along another of both side portions of the thick area.

2. The production method for the blank steel plate according to claim 1, wherein in the forming process, a press device is used, the press device including a punch, a blank holder that is disposed adjacent to the punch, a die that is disposed facing the blank holder and facing a part of the punch, and a pad that is disposed adjacent to the die and facing the punch, in the first step, the starting material is pushed by the blank holder with one of the second areas of the starting material sandwiched between the punch and the pad, and the push is continued while another of the second areas of the starting material is sandwiched between the blank holder and the die, so as to form the first area that inclines with respect to the second areas, and in the second step, the one second area is pushed by the punch and the pad until the one second area becomes flush with the other second area, and the first area is compressed by the punch and the die so as to form the thick area, a thickness of which is increased from a thickness of the starting material.

3. The production method for the blank steel plate according to claim 1, wherein in the first step, a width L [mm] of the inclined first area, a thickness t [mm] of the starting material, an inclination angle θ [°] of the first area with respect to the second area, and a yield strength YS [MPa] of the starting material satisfy a condition represented by a following Formula (1).

$$(L/t)\times(1/\cos\theta)\leq -5.1\times10^{-6}\times(YS)^2+11.5 \quad (1)$$

4. The production method for the blank steel plate according to claim 1, wherein a hardness of the blank steel plate at a thickness center of the thick area is higher than a hardness thereof at a thickness center of the thin area.

5. The production method for the blank steel plate according to claim 1, wherein an increase in the thickness of the thick area to the thickness of the thin area is 20% or more.

6. A production device for a planar blank steel plate, wherein the production device for the blank steel plate uses, as a starting material, a steel plate having a thickness that is constant and forms the starting material into the blank steel plate by press working, the production device including a punch, a blank holder that is disposed adjacent to the punch, a die that is disposed facing the blank holder and facing a part of the punch, and a pad that is disposed adjacent to the die and facing the punch, and wherein an interval between the blank holder and the pad is identical to a width of the thick area of the blank steel plate, the blank steel plate is homogeneous across its entirety, the blank steel plate includes a belt-shaped thick area with an increased thickness, and thin areas that are adjacent to both sides of the thick area and have a thickness smaller than the thickness of the thick area, on one of a front surface and a back face of the blank steel plate, a step height in thickness is formed along one of both side portions of the thick area, and on another of the front surface and the back face of the blank steel plate, a step height in thickness is formed along another of both side portions of the thick area.

7. The production device for the blank steel plate according to claim 6, wherein a projecting portion is provided on a surface of the die, the surface facing the blank holder, and the projecting portion has a height identical to or smaller than a thickness of the starting material.

* * * * *